US005607452A

United States Patent [19]

Michaud

[11] Patent Number: 5,607,452

[45] Date of Patent: Mar. 4, 1997

[54] PACIFIER HOLDER

[76] Inventor: Barbara Michaud, 17 - 4th Avenue, P.O. Box 11, Clair, N.B., Canada, E0L 1B0

[21] Appl. No.: 348,480

[22] Filed: Dec. 2, 1994

[51] Int. Cl.[6] ..... A61J 17/00

[52] U.S. Cl. ..... 606/234; 24/306; 24/339

[58] Field of Search ..... 24/306, 336, 339; 5/93.1, 100, 503.1, 658; 248/205.2, 230.7, 908; 606/234–236; D24/193–199

[56] References Cited

U.S. PATENT DOCUMENTS

| | | | |
|---|---|---|---|
| 1,178,594 | 4/1916 | Nixon | 446/227 |
| 1,279,615 | 9/1918 | Meter | 446/227 |
| 3,289,986 | 12/1966 | Martin | 606/234 |
| 4,121,798 | 10/1978 | Schumacher et al. | 24/336 |
| 4,695,026 | 9/1987 | Medley | 248/902 |
| 4,955,914 | 9/1990 | Caniglia et al. | 606/235 |
| 5,049,127 | 9/1991 | Tseng | 606/236 |

*Primary Examiner*—Glenn Dawson
*Attorney, Agent, or Firm*—Mario D. Theciault

[57] ABSTRACT

The present invention relates to a holder for retaining a pacifier in a baby crib in a position which is readily accessible to a child. The pacifier holder is preferably made of rubber material, and includes a mounting and a pacifier holder. The mounting mounts the pacifier holder to a vertical bar of a baby crib and is either a wrap around flap partly covered with VELCRO™ material, or a clip-on tubular member. In both embodiments a friction of the rubber material against the crib bar retains the pacifier in place on the bar. Furthermore, the mounting of both embodiments is adaptable to crib bars of different sizes and shapes. The pacifier holder includes a flexible upper finger and a flexible lower finger, defining a holding slot for retaining a pacifier therein. The upper finger is optionally curved upwardly in the shape of a hook for retaining a variety of baby articles.

16 Claims, 7 Drawing Sheets

PACIFIER HOLDER

FIELD OF THE INVENTION

The present invention relates to holders for pacifiers and more specifically, to a holder for retaining a pacifier in a baby crib in a position which is readily accessible to a child.

BACKGROUND OF THE INVENTION

Most parents rely on pacifiers and soothers for comforting an infant from many difficulties associated with babies' life. Pacifiers are often used to lengthen the span between meals, to silence an infant in need of his mother's presence, or for calming teething pains. Once a baby has learned to take objects to his mouth, pacifiers becomes invaluable possessions, and normally remain as such until the infant reach the age of one year or so.

At night, most parents take the pacifier away from the baby to prevent loosing the nipple amongst the crib's sheets and blankets. Although it is relatively easy to put the nipple away once the child is asleep, it is a known fact that babies are earlier than their parents to wake up in the morning, and to claim restitution. Consequently, most parents remember having seen their baby at early morning, standing in his crib, gesticulating and stretching over the side bar trying to grasp his pacifier on a nearby drawer chest, or pointing at the pacifier and crying in despair for someone to give it to him.

Numerous articles have been developed to retain a pacifier within reach of a child. Several prior art items propose a straplike retainer for looping around the infant's neck or arm at one end, and for attachment to a pacifier at the other end.

Other prior art articles propose similar straplike retainers which have clamps for attachment to the infant's upper body garment. For example, U.S. Pat. No. 4,903,698 issued Feb, 27, 1990 to Huber et al. describes a tethering device comprising an elongated strap, with attachment means at one end for attachment to a baby's pacifier or bottle, and a clamp and a slit at the opposite end for detachable attachment to the infant's clothing.

Another example of a straplike retainer is described in U.S. Pat. No. 4,990,157 issued Feb. 5, 1991 to Roberts et al. This patent describes a flexible string having at one end a plastic clip for attachment to the infant's clothing, and a loop at the other end for retaining a baby soother.

Although the articles described in the prior art are undoubtedly very useful during daytime activities, they are not particularly suitable for use during the child's sleep. The strap or string may become entangled around the baby's limbs or neck, under his head or face, or around a crib's bar, and cause thereby much discomfort to the infant. Likewise, the pacifier may end up under the baby's body, and not be found when wanted. For these reasons straplike retainers for pacifiers and soothers for attachment to the baby's clothing are not appropriate for using in a baby crib.

SUMMARY OF THE INVENTION

In the present invention, however, there is provided a pacifier holder for retaining a pacifier in a baby crib in such a way that even a very young infant can grasp and easily pull the pacifier free from the holder.

The pacifier holder of the present invention is preferably made of a resilient material such that the holding slot is adaptable to soother's rings of different cross sections, while retaining the same with substantial resistance.

The mounting portion of the holder is also preferably made of a resilient material such it can be clamped to a crib's bar at any height, and remain at that height due to a friction of the resilient material with the surface of the bar.

In accordance with one aspect of the present invention, the mounting portion comprises a C-shaped tubular member having flexible walls, and an adhesive strap enclosing the C-shaped tubular member. The mounting portion is adaptable to bars of different diameters and different shapes, such that one model of pacifier holder is suitable for use with a variety of baby cribs.

One advantage of the present invention is that a pacifier is conveniently held at a position where a baby can take it whenever he wants it, without having to implore help from his parents. A further advantage of the present invention is that the holder offers a neat storage for a pacifier. Once the baby is asleep, a parent inserts the pacifier in the holder of the present invention, where it remains in a clean condition. This is a commendable improvement over the present method of storing the soother on a nearby table which is not necessarily sparkling clean, or of leaving it in the crib and letting it fall on the floor as a result of the baby's movements during the night.

In accordance with another aspect of the present invention, there is provided a pacifier holder with an elongated clamp having resilient walls biased against one another by a profiled spring, embedded in the pacifier holder. The elongated clamp is formed to adapt to most popular cribs' bar sizes and shapes.

The particular advantage of this embodiment of the present invention is that the spring profile of the clamp maintains a constant pressure of the resilient material of the walls against the surface of the bar to retain the holder in place on the bar. A further advantage of the configuration of the elongated clamp is that the pacifier holder is easily installed by pushing and clipping it over a bar.

In a further embodiment of the present invention, the pacifier holder has the figure of an elephant head on which the trunk is the upper holding member, and the mouth is the lower holding member. The upper holding member and the lower holding member define a holding slot in which a handle ring of a pacifier is retained. The appearance of this embodiment is particularly appropriate for providing a certain fantasy normally associated with baby objects.

The trunk of the figure provides a lever for opening the holding groove of the pacifier holder, for insertion of a handle ring of a pacifier therein. The lower holding member is made of a resilient material whereby a baby can easily pull the pacifier free from the holding slot in a downward direction.

Advantages of this embodiment of the present invention are that the upper holding member, or the trunk of the figure, forms a hook for retaining a pacifier handle ring when the baby does not quite has the dexterity required to put back the pacifier in the holding slot. The hook is similarly used to retain baby articles suchlike teething rings, rattling toys, or a favourite blanket. Thus the hook of this embodiment provides several valuable functions useful to baby crib environment.

BRIEF DESCRIPTION OF THE DRAWINGS

The preferred embodiments of the invention will be further understood from the following description, with reference to the drawings in which.

DETAILED DESCRIPTION OF THE PREFERRED EMBODIMENTS

Figure 1:
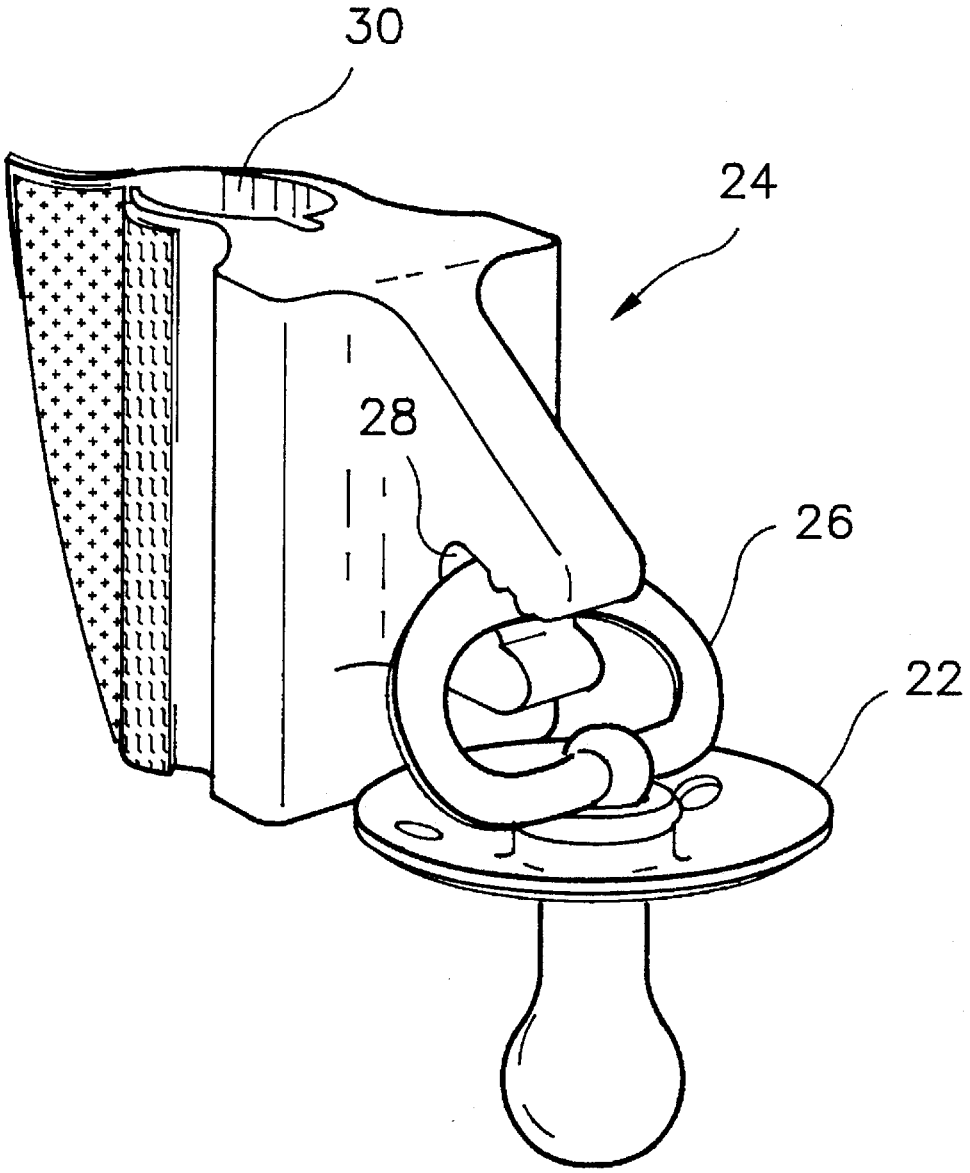
FIG. 1 is an illustration of the first preferred embodiment of the pacifier holder, with a pacifier retained in the holding slot.
Figure 2:
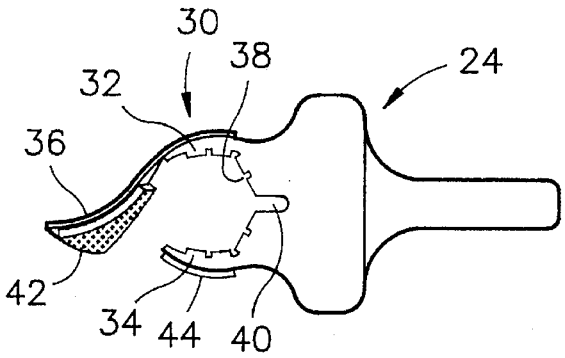
FIG. 2 is a top view of the first preferred embodiment of the pacifier holder.

Referring to FIG. 1, there is illustrated a pacifier 22, and a pacifier holder 24. The pacifier 22 is the type with a handle ring 26. The pacifier 22 is held in the holder 24 by the handle ring 26 inserted inside a slot 28 in the front portion of the pacifier holder 24. The pacifier holder 24 has a C-shaped tubular member 30 for mounting on a vertical bar of a baby crib, such that the pacifier 22 is held in a position which is accessible to an infant inside the crib.

The C-shaped tubular member 30, and the slot 28 are better illustrated on FIGS. 2 to 7. The pacifier holder 24 is made of a resilient material, and is preferably made of a rubber material having a large coefficient of friction with painted wood surfaces, or with plastic surfaces. The C-shaped tubular member 30 comprises two flexible walls 32, 34, and a flap 36 extending from a first wall 32 to overlap a second wall 34.

Each wall 32, 34 has longitudinal serrations 38 along its inside surface, to weaken the wall such that the tubular member is flexible to adapt to various shapes and dimensions of crib bars. The C-shaped tubular member 30 further has a groove 40 along a gorge portion thereof. The groove 40 provides for further flexibility of the C-shaped tubular member 30 to expand or to contract around bars of various shapes and dimensions. The serrations 38 and the groove 40, cooperating with contacting surfaces of the tubular member 30, enhance a good circumferential adhesion of the pacifier holder 24 to the crib's bar.

Flap 36 is partly covered with gripping material 42, and wall 34 is partly covered with mating material 44. The gripping material 42 and the mating material 44 are preferably of the type sold under the trade name VELCRO™. Upon installation of this preferred embodiment of the pacifier holder 24, the flap 36 extending from wall 32 is wrapped tightly around a vertical bar of a crib, and attached to the mating material of the opposite wall 34, securing thereby the pacifier holder 24 in place, The friction of the rubber material of the C-shaped tubular member 30 retains the pacifier holder 24 from slipping down, and from rotating about the bar, even under tension from an infant removing the pacifier 22 from slot 28.

The length of the C-shaped tubular member 30 is approximately at least 4 times the diameter of the largest bar on which the pacifier holder 24 will be mounted. This ratio provides sufficient surface of contact with the bar to firmly retain the pacifier holder 24 in place.

Figure 5:
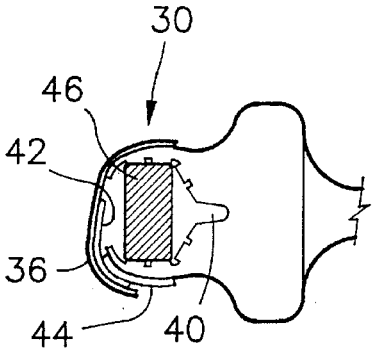
FIG. 5 is a top view of the C-shaped tubular member of the holder, mounted on a rectangular crib bar.
Figure 3:
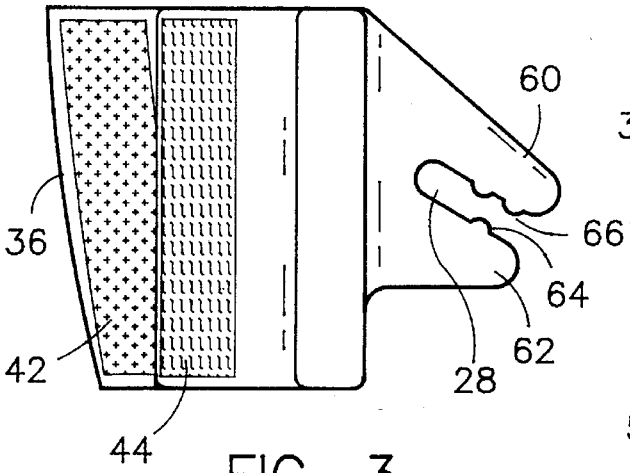
FIG. 3 is a side view of the first preferred embodiment of the pacifier holder.
Figure 6:
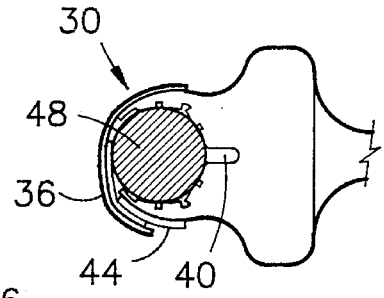
FIG. 6 is a top view of the C-shaped tubular member of the holder, mounted on a large size crib bar.
Figure 7:
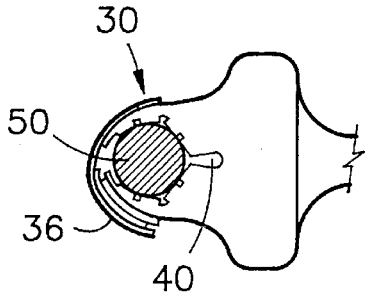
FIG. 7 is a top view of the C-shaped tubular member of the holder, mounted on a small size crib bar.
Figure 4:
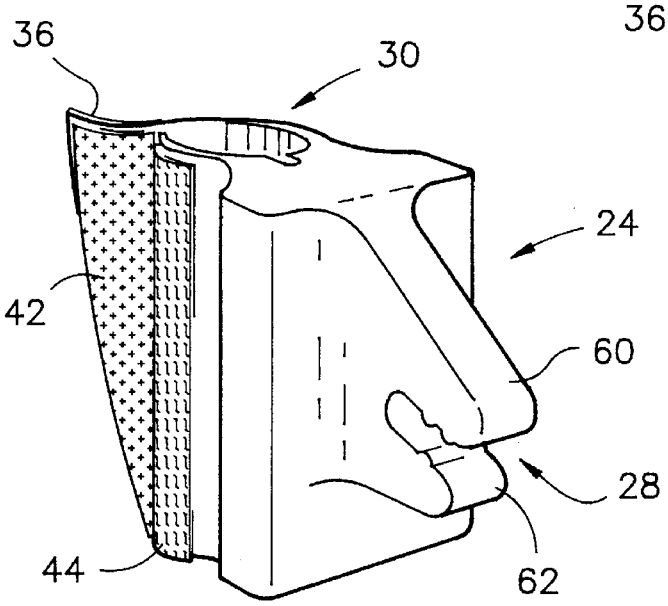
FIG. 4 is a perspective view of the first preferred embodiment of the invention.
Figure 8:
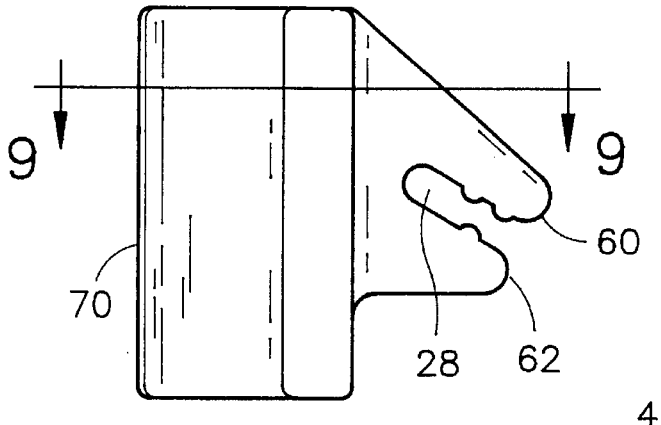
FIG. 8 is a side view of a second preferred embodiment of the pacifier holder.
Figure 11:
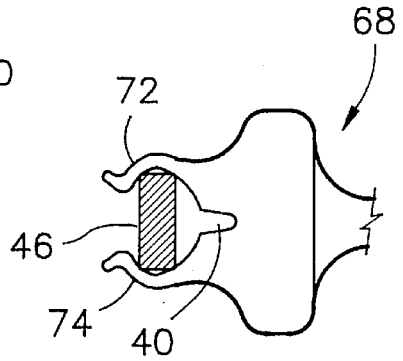
FIG. 11 is a top view of an elongated clamp mounting member, clamped on a rectangular crib bar.
Figure 9:
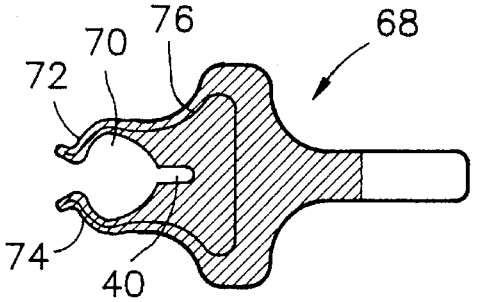
FIG. 9 is a section view of a second preferred embodiment of the pacifier holder through line 9—9 of FIG. 8. The figure illustrates a pacifier holder having an elongated clamp mounting member.

FIGS. 5, 6 and 7 illustrate respectively the C-shaped tubular member 30 mounted on a rectangular crib bar 46, on a large diameter crib bar 48, and on a small diameter crib bar 50. It is important to note the contraction and expansion of the groove 40 when the pacifier holder is installed on a large object such as illustrated in FIG. 5, in comparison to an installation on a small bar as illustrated in FIG. 7. The groove 40 provides diametrical adjustment of the C-shaped tubular member 30, for a good adhesion of walls 32 and 34 against the surface of the mounting bar. The variety of dimensions and shapes of crib bars illustrated on FIGS. 5 to 7 covers all bars found on common baby cribs available commercially.

Referring back now to FIGS. 3 and 4, the front part of the preferred embodiment of the pacifier holder 24 comprises a pacifier mounting portion having an upper finger 60 and a lower finger 62 defining a holding slot 28. The lower finger 62 has transversal hump 64 projecting toward the inside of holding slot 28, and the upper finger 60 has two similar transversal swellings 66 projecting towards the lower finger 62. Both upper swellings 66 are positioned astride the lower hump 64, such that the interference therefrom improves the holding efficacy of the holding slot 28.

Both the upper finger 60 and the lower finger 62 are made of a resilient material, and especially moulded integrally of the same rubber material as for the C-shaped tubular member 30, such that a handle ring 26 of a pacifier 22 is easily inserted in slot 28, and easily withdrawn therefrom. The distance of the gap of the holding slot 28, and of the clearance between hump 64 and swellings 66, are dimensioned to accommodate thicknesses of handle rings of a majority of pacifiers available commercially. Accordingly, a preferred gap for holding slot 28 is about 3/16", and a preferred clearance between hump 64 and swellings 66 is about 1/16".

Holding slot 28 is oriented downwardly such that a baby can pull a pacifier therefrom without difficulties, from a downward direction, as for example, when the baby is lying in his crib. Thereupon, a preferred angle of orientation for slot 28 is about 15°.

A second preferred embodiment of the invention is illustrated on the FIGS. 8 to 13. This embodiment also has an upper finger 60, a lower finger 62 and a holding slot 28 to retain a pacifier. This embodiment has an elongated clamp 70 comprising a first resilient wall 72 and a second resilient wall 74. The elongated clamp 70 further has a groove 40 along the gorge portion thereof. The groove 40 provides for further flexibility of the elongated clamp 70 to expand or to contract around bars of various shapes and dimensions. This second preferred embodiment is also preferably made of a rubber material.

Both walls 72 and 74 are shaped according to the profile of a formed flat spring 76 embedded in the clamp's backing member of the pacifier holder 68. The shape of both wall 72 and 74 defines a multi-radii cross-section cylinder, whereby a contact surface of the elongated clamp 70 with a range of sizes of crib bars is optimum. The shape of both walls 72 and 74 are further curved outwardly from a central axis of the cylindrical opening of the clamp, such that the pacifier holder 68 can be pushed against, and clipped onto a variety of bars on commercially available cribs.

Figure 12:
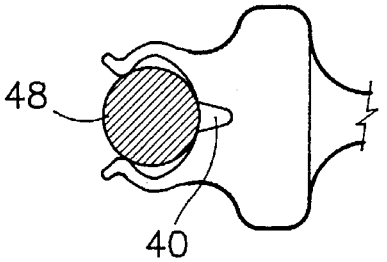
FIG. 12 is a top view of an elongated clamp mounting member, clamped on a large size crib bar.
Figure 13:
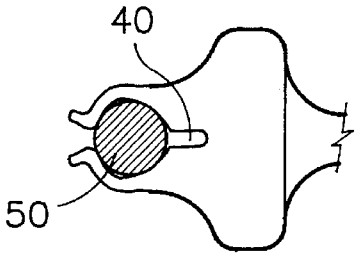
FIG. 13 is a top view of an elongated clamp mounting member, clamped on a small size crib bar.
Figure 10:
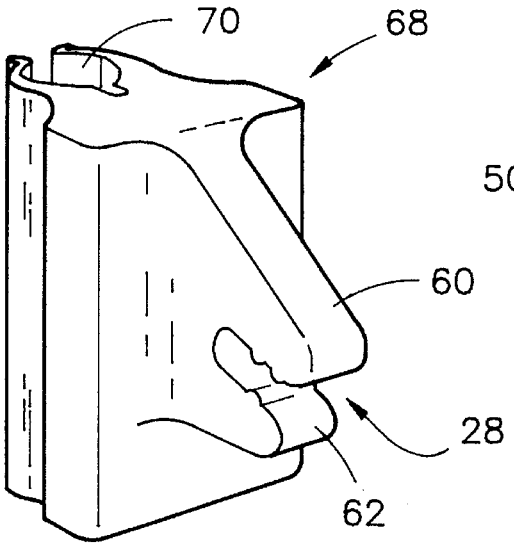
FIG. 10 is a perspective view of a second preferred embodiment of the pacifier holder.

In this respect, FIGS. 12 to 13 illustrate respectively the second preferred embodiment of the invention mounted on a rectangular bar 46 having dimensions of ½ inch by 3/16 inch, a circular bar 48 of ½ inch in diameter, and on a circular bar 50 of ⅜ inch in diameter.

Figure 14:
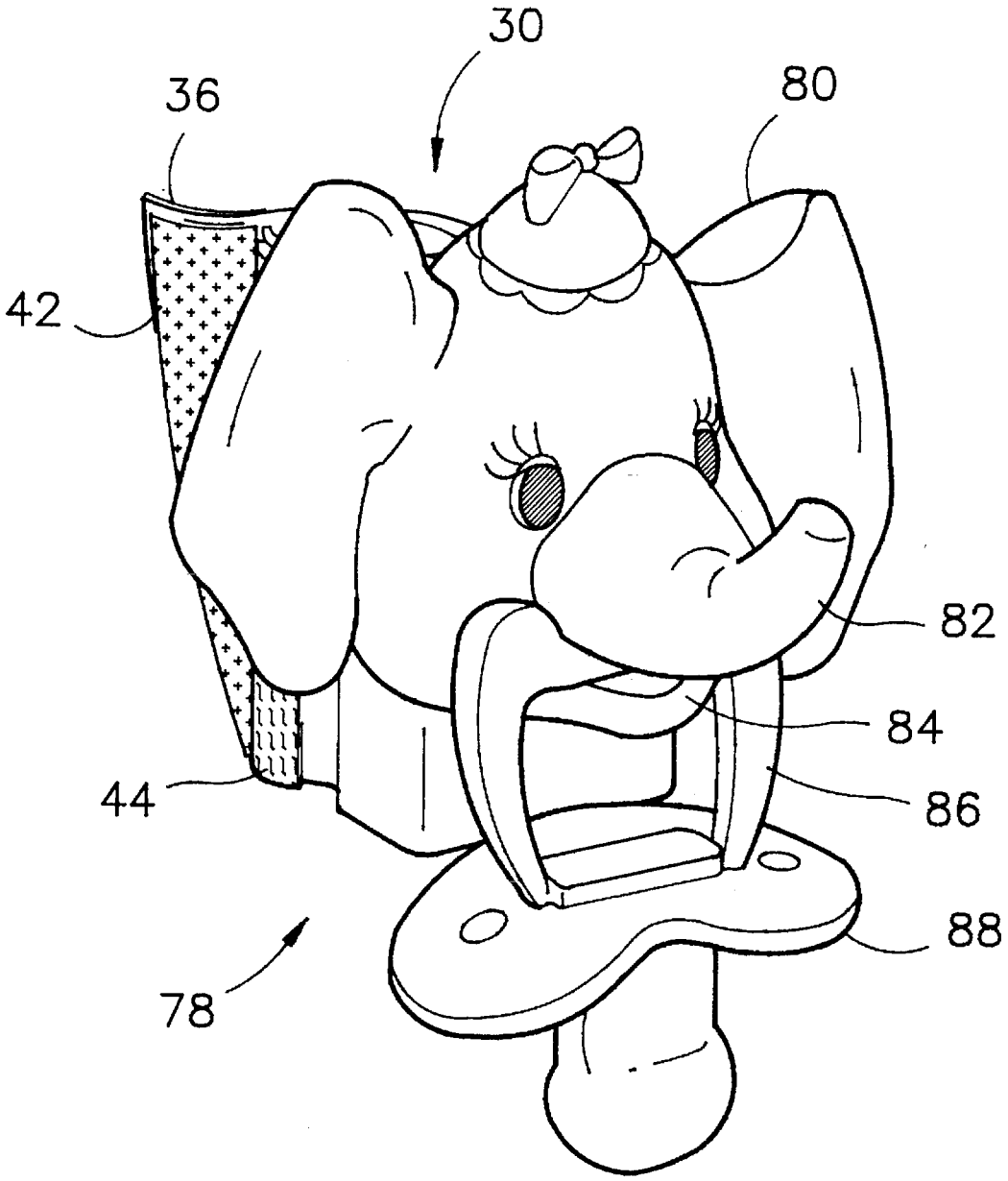
FIG. 14 is a third preferred embodiment of the pacifier holder. The holding portion of the embodiment has the form of an elephant head, where the trunk is a thumb lever to open the mouth of the figure for insertion of the pacifier therein.
Figure 15:
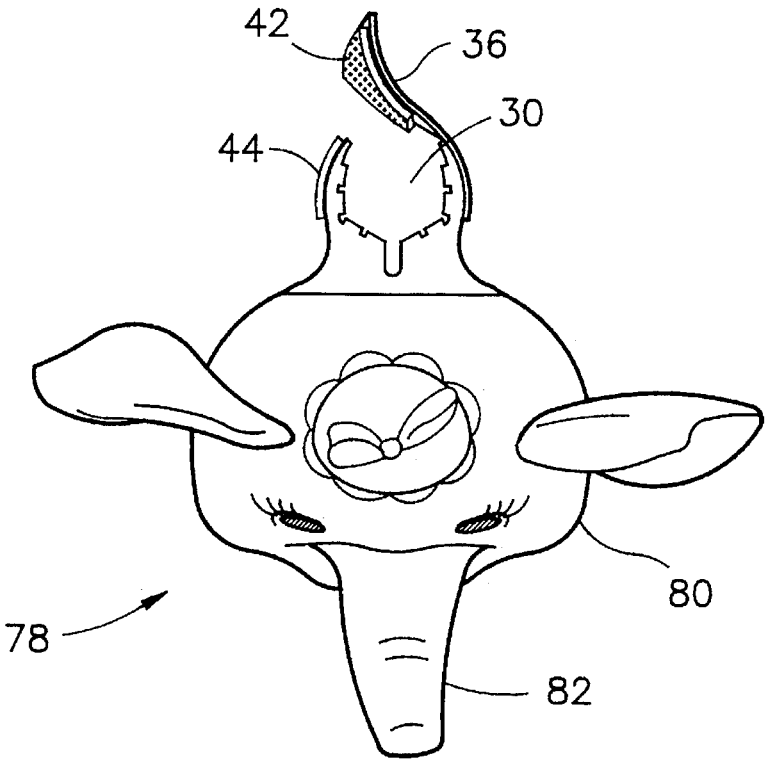
FIG. 15 is a top view of the third preferred embodiment of the pacifier holder, illustrating the C-shaped tubular member.
Figure 16:
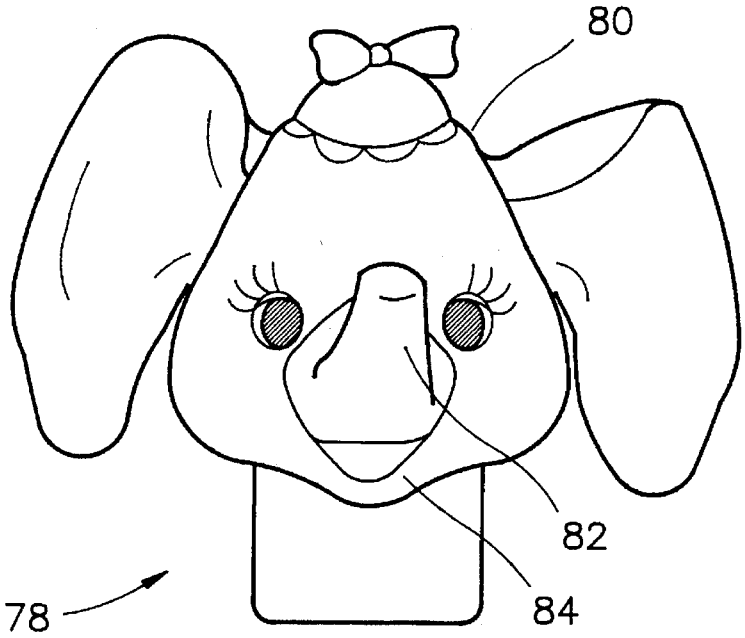
FIG. 16 is a front view of the third preferred embodiment of the pacifier holder.

FIGS. 14, 15 and 16 illustrate a third preferred embodiment of the pacifier holder 78. This embodiment has the figure of an elephant head 80 on which the trunk 82 is the upper holding member, and the mouth 84 is the lower holding member. The upper holding member 82 and the lower holding member 84 define a holding slot in which a handle ring 86 of a pacifier 88 is retained.

This embodiment has a C-shaped tubular member 30 for mounting on a vertical bar of a crib. The mounting member 30 is similar in design as for the first preferred embodiment described earlier. That is, it has a flap 36, covered with gripping material 42, and mating material 44 on the outside wall of the tubular member 30. The mounting portion of the pacifier holder 78 is better illustrated on FIG. 15. This third preferred embodiment 78 is also preferably made entirely of a rubber material.

Figure 17:
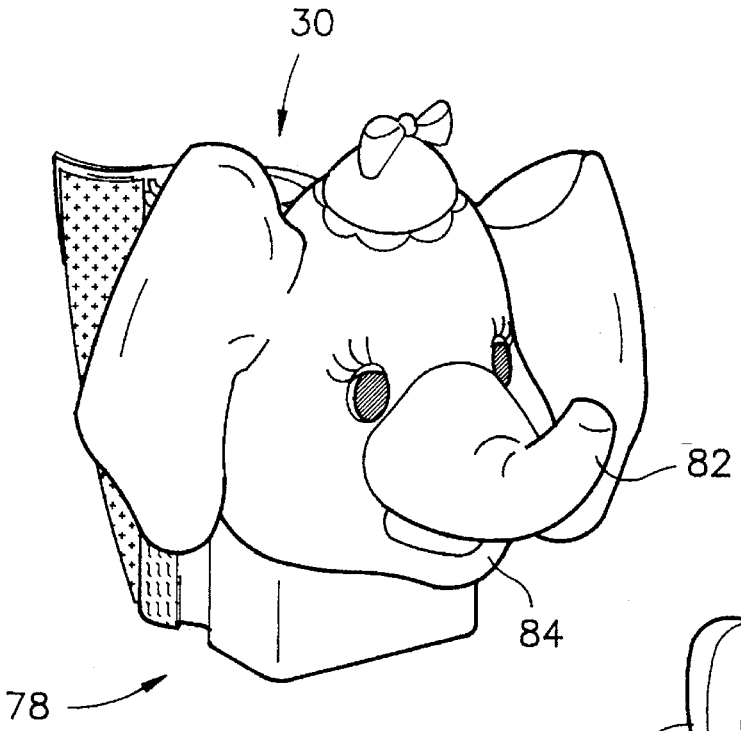
FIG. 17 is a perspective view of the third preferred embodiment of the invention.
Figure 18:
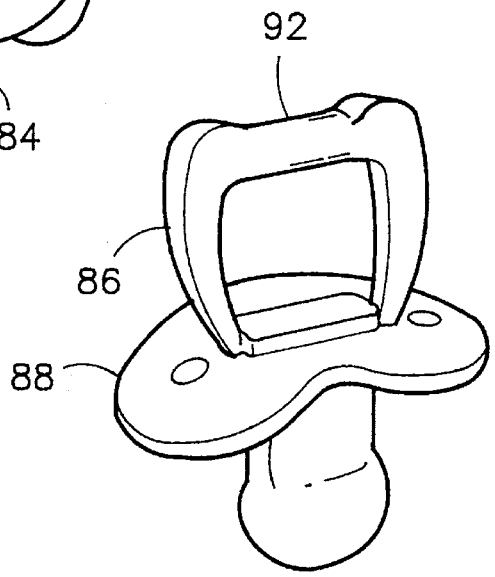
FIG. 18 is a pacifier having a holding ring shaped according to the slot of the figure's mouth.
Figure 19:
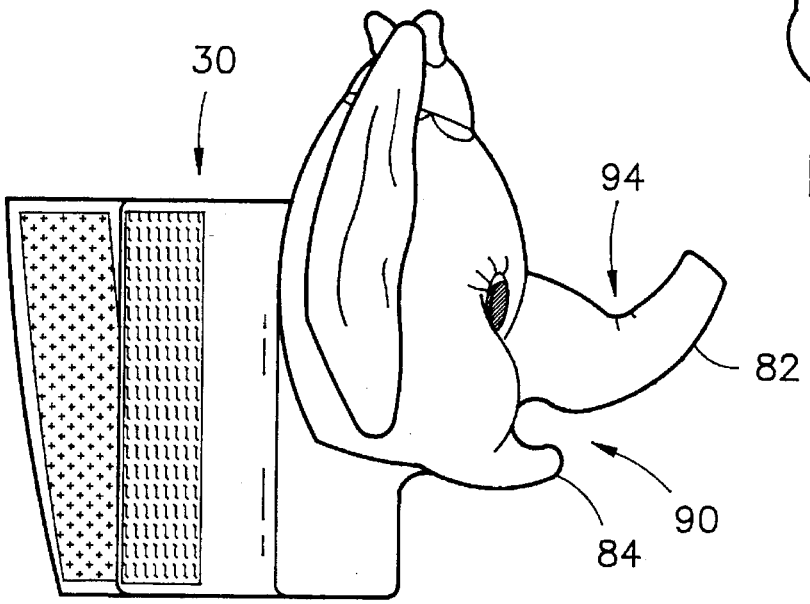
FIG. 19 is a side view of the third preferred embodiment of the pacifier holder, illustrating the shape of the mouth of the animal figure.

Referring now to FIGS. 17, 18 and 19, the major advantage of this embodiment is that the trunk 82 of the figure provides leverage for opening the holding slot 90 of the pacifier holder 78 for insertion therein of a handle ring 86 of a pacifier 88. The lower holding member 84 is relatively thin and flexible whereby a baby can easily remove the pacifier 88 from the holding slot 90 by pulling on it in a downward direction.

The upper holding member 82 has a hook portion 94 for retaining a pacifier handle ring 86, or a handle ring of a toy for example, for use by a toddler which is grown enough to remove the object from such hook 94.

A preferred pacifier 88 for use with this third preferred embodiment 78 is the type having a handle ring 86 with cross section 92 which is similar to the profile of the holding slot 90. A preferred profile for the bottom of holding slot 90 is a cylindrical shape having a diameter of approximately 3/16". Such a profile corresponds to the cross-section of handle rings of a majority of pacifiers on the market.

Figure 20:
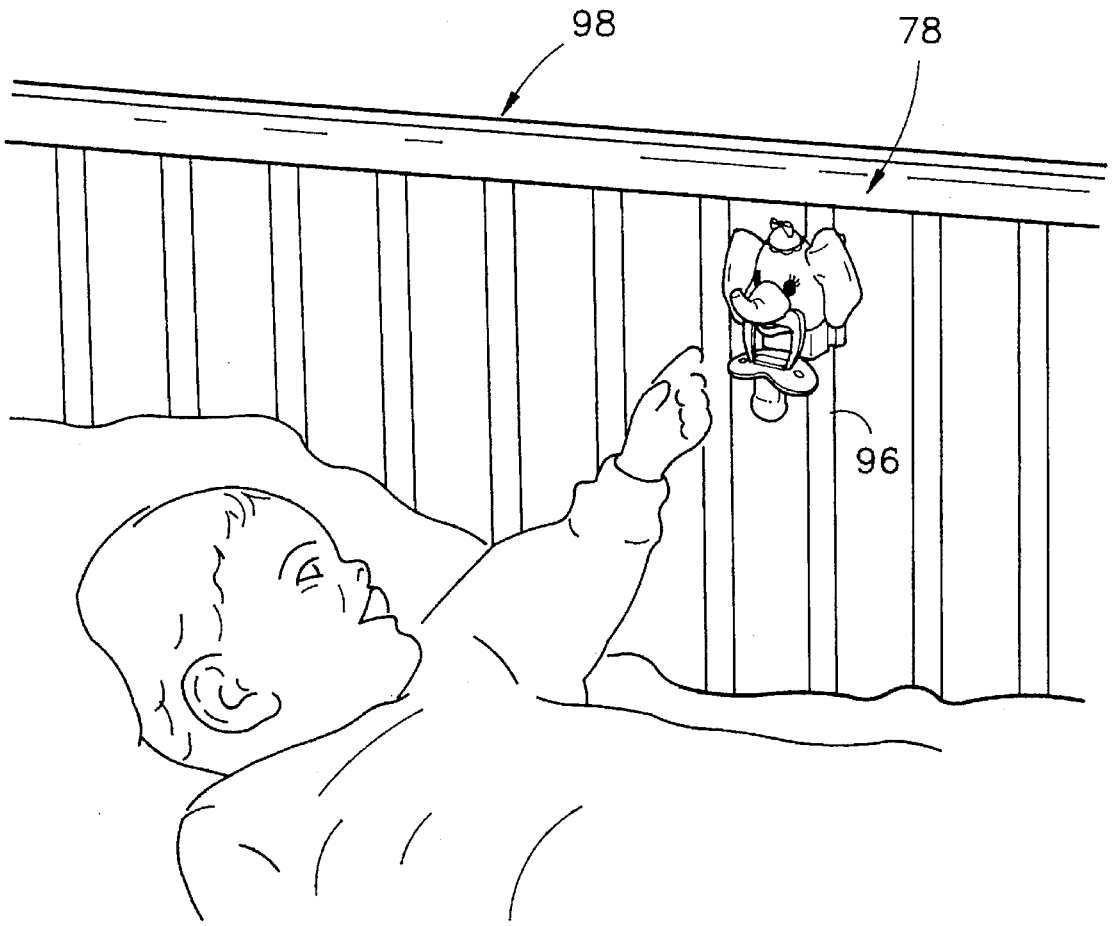
FIG. 20 illustrates a preferred installation of the third preferred embodiment of the invention on a vertical bar of a baby crib.

A preferred installation of the pacifier holder 78, 68 or 24 is illustrated on FIG. 20. The pacifier holder 78 is shown installed on a vertical bar 96 of a baby crib 98. The pacifier holder is illustrated at a preferred height along the bar 96 which is accessible to the child.

While the preferred, embodiments of the invention have been described with a downward oriented slot, with a wrap-around, or a clip-on mounting member, and as an elephant head, other mounting methods and other representations of baby appealing figures are possible without altering the structure of the invention.

Therefore, the preferred embodiments of the invention as described herein are not limited thereto, and it will be apparent to those skilled in the art that numerous modifications form part of the present invention insofar as they do not depart from the spirit, nature and scope of the claimed and described invention.

I claim:

1. A combination of a pacifier and a pacifier holder for mounting on a baby crib, said pacifier holder having:

tubular mounting means for firmly retaining said pacifier holder on a vertical bar of said baby crib;

holding means having a holding slot for detachably retaining said pacifier;

said pacifier having a handle ring, at least a portion of which has a shape which corresponds loosely to said holding slot, said holding slot being configured for releasably receiving said handle ring of said pacifier such that when said pacifier holder is mounted on said vertical bar, an infant in said crib can take said pacifier from said pacifier holder.

2. A combination of a pacifier and a pacifier holder as claimed in claim 1 wherein said holding slot is a downwardly oriented slot, whereby said infant can pull said pacifier from said pacifier holder from a downward direction.

3. A combination of a pacifier and a pacifier holder as claimed in claim 1 wherein said pacifier holder is made of a resilient rubber material.

4. A combination of a pacifier and a pacifier holder as claimed in claim 1 wherein said holding means comprises an upper holding member which is curved in the shape of a hook for retaining baby articles.

5. A pacifier holder for retaining a pacifier in a baby crib, comprising:

mounting means for retentively clamping a vertical bar of said baby crib, said mounting means defining a mounting axis mountable along a longitudinal axis of said vertical bar;

finger means being integrally formed with a portion of said mounting means, and extending away from said mounting means in a direction generally perpendicular to said mounting axis;

said finger means comprising a first finger and a second finger of which at least one is made of a resilient material, said first and second fingers being spaced apart a distance defining a holding slot for retaining therein a handle ring of said pacifier;

said first finger having a hump protruding towards said second finger, and said second finger having two swellings protruding towards said first finger, said two swellings being positioned astride said hump;

whereby a clearance between said hump and said swellings is less than a gap of said slot, for retaining said handle ring of said pacifier in a restrictive manner.

6. A pacifier holder as claimed in claim 5 wherein, a length of said gap is about 3/16", and a length of said clearance is about 1/16".

7. A pacifier as claimed in claim 5 wherein, an orientation of said holding slot is about 15° from a line normal to said mounting axis.

8. A pacifier holder as claimed in claim 5 wherein, said mounting means for clamping a vertical bar is a C-shaped tubular member having;

a first flexible wall, a second flexible wall, an adhesive strap extending from said first flexible wall and overlapping said second flexible wall, whereby an installation of said pacifier holder on a vertical bar is effected by positioning said C-shaped tubular member over said bar, and by wrapping tightly said adhesive strap around said bar, and over said second wall, causing said adhesive strap to adhere to said second wall.

9. A pacifier holder as claimed in claim 8 wherein said C-shaped tubular member is made of a resilient material.

10. A pacifier holder as claimed in claim 9 wherein said resilient material is a resilient rubber material having a large coefficient of friction against painted wood surfaces, and plastic surfaces.

11. A pacifier holder as claimed in claim 8 wherein said first flexible wall, and said second flexible wall are longitudinally serrated for providing flexibility of said C-shaped tubular member to adapt to crib bars of different shapes and diameters.

12. A pacifier holder as claimed in claim 8 wherein said C-shaped tubular member comprises a groove along a gorge portion thereof for providing flexibility of said C-shaped tubular member to adapt to crib bars of different shapes and diameters.

13. A pacifier holder as claimed in claim 10 wherein a length of said C-shaped tubular member is about 4 times a diameter thereof, for providing a good adherence of said C-shaped tubular member to a surface of said bar.

14. A pacifier holder as claimed in claim 5 wherein, said mounting means for clamping a vertical bar is an elongated clamp having a tubular opening, said elongated clamp comprising;

a clamp backing member, a first resilient wall extending from said clamp backing member, and defining a first segment of said tubular opening, a second resilient wall also extending from said clamp backing member, and defining a second segment of said tubular opening, said first resilient wall and said second resilient wall having outwardly curved edges, whereby said elongated clamp is forced to clip over said bar by pushing said pacifier holder against said bar.

15. A pacifier holder as claimed in claim 14 wherein, said first resilient wall and said second resilient wall are biased against one another by a formed flat spring embedded in said first resilient wall, in said second resilient wall, and in said backing member.

16. A pacifier holder as claimed in claim 14 wherein said tubular opening has a diameter of between about 3/8" to about 1/2".

* * * * *